US006063017A

United States Patent [19]

Romanauskas et al.

[11] Patent Number: 6,063,017

[45] **Date of Patent: *May 16, 2000**

[54] METHOD AND APPARATUS CAPABLE OF PREVENTING VERTICAL FORCES DURING ROTOR FAILURE

[75] Inventors: William Andrew Romanauskas, Southbury; David Michael Carson, Newtown; Raymond Gary Potter, Southbury, all of Conn.

[73] Assignee: Sorvall Products, L.P., Newtown, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/843,691

[22] Filed: Apr. 10, 1997

[51] Int. Cl.[7] ..... B04B 5/02; B04B 7/02; B04B 7/06

[52] U.S. Cl. ..... 494/12; 494/16; 494/60

[58] Field of Search ..... 494/12, 16–21, 494/26, 33, 43, 60, 61, 85; 210/360.1, 781; 74/572

[56] References Cited

U.S. PATENT DOCUMENTS

| | | | |
|---|---|---|---|
| Re. 14,331 | 7/1917 | Parker | 494/60 |
| 1,305,796 | 6/1919 | Griscom | 494/60 |
| 1,914,764 | 6/1933 | Williams | 494/60 |
| 2,608,344 | 8/1952 | Pickels | 494/12 |
| 2,628,773 | 2/1953 | Boileau | 494/60 |
| 2,885,188 | 5/1959 | Pickels et al. | 494/61 |
| 3,101,322 | 8/1963 | Stallman et al. . | |
| 3,276,679 | 10/1966 | Booth | 494/60 |
| 3,339,836 | 9/1967 | Mitchell et al. | 494/16 |
| 3,391,862 | 7/1968 | Jacobson et al. | 494/12 |
| 3,604,617 | 9/1971 | Patterson . | |
| 3,623,657 | 11/1971 | Trump | 494/60 |
| 3,662,619 | 5/1972 | Seeliger . | |
| 3,860,166 | 1/1975 | Anderson | 494/20 |
| 3,958,753 | 5/1976 | Durland et al. | 494/24 |
| 3,970,245 | 7/1976 | Aeschlimann | 494/12 |
| 3,990,633 | 11/1976 | Stahl et al. . | |
| 4,053,104 | 10/1977 | Penhasi et al. | 494/60 |
| 4,054,243 | 10/1977 | Volkov et al. | 494/20 |
| 4,111,067 | 9/1978 | Hodson . | |
| 4,132,130 | 1/1979 | Schneider . | |
| 4,196,844 | 4/1980 | Jacobson | 494/12 |
| 4,507,047 | 3/1985 | Coons . | |
| 4,509,896 | 4/1985 | Linsker . | |
| 4,568,325 | 2/1986 | Cheng et al. . | |
| 4,693,702 | 9/1987 | Carson et al. . | |
| 4,753,630 | 6/1988 | Romanauskas . | |
| 4,753,631 | 6/1988 | Romanauskas . | |
| 4,764,162 | 8/1988 | Romanauskas | 494/61 |
| 4,822,330 | 4/1989 | Penhasi . | |
| 5,279,538 | 1/1994 | Carson . | |
| 5,538,492 | 7/1996 | Potter | 494/12 |
| 5,562,554 | 10/1996 | Carson . | |
| 5,855,545 | 1/1999 | Kishi et al. . | |

FOREIGN PATENT DOCUMENTS

| | | |
|---|---|---|
| 38 06 284 | 4/1989 | Germany . |

*Primary Examiner*—Charles E. Cooley
*Attorney, Agent, or Firm*—Ohlandt, Greeley, Ruggiero & Perle, L.L.P.

[57] ABSTRACT

A method and apparatus which are capable of controlling the motion of a rotor body fragment after a rotor failure has occurred within a centrifuge assembly which comprises a rotor body, a centrifuge chamber and a centrifuge lid. The moment of the rotor body fragment can be controlled such that it moves along the centrifuge chamber away from the centrifuge lid by any of the following: (a) adjusting the center of gravity of the rotor such that it is below the strike point plane of the rotor; (b) adjusting the shape of the centrifuge chamber to conform to the rotor body shape; (c) sloping the guard ring such that the lower portion is furthest away from the centrifuge chamber; (d) varying the strength or stiffness of the guard ring or centrifuge chamber at or above the center of gravity of the rotor body fragment; and (e) adding a ring member to the top of the centrifuge rotor body.

11 Claims, 6 Drawing Sheets

METHOD AND APPARATUS CAPABLE OF PREVENTING VERTICAL FORCES DURING ROTOR FAILURE

The present invention generally relates to a centrifuge, and in particular, to a centrifuge rotor wherein the movement of a centrifuge rotor body fragment after a rotor failure has occurred is controlled to avoid contact with the lid or door of the centrifuge.

BACKGROUND OF THE INVENTION

A centrifuge rotor is a relatively massive member used within a centrifuge instrument to expose a liquid sample to a centrifugal force field. The rotor is provided with a plurality of cavities in which containers carrying the liquid sample are received. The rotor has a central, axial mounting recess provided therein, whereby the rotor may be mounted to a shaft extending from a source of motive energy.

The possibility exists that, in use, the rotor may break apart due either to (i) fatigue failure of the rotor material, (ii) the imposition of excessive centrifugally induced stresses when the rotor is rotated past its predetermined rated speed (overspeed failure), or (iii) failure from the accumulated effects of corrosion caused by sample spillage. A failure produces a number of rotor body fragments each of which carries a portion of the kinetic energy of the rotor. A containment system is provided in the centrifuge instrument in order to contain the resultant rotor body fragments within the confines of the instrument, thus avoiding damage to people and/or property.

The size of the fragments usually depends upon the cause of the rotor failure. In a rotor failure caused by corrosion, for example, the fragments are relatively small, because the region of the rotor affected by corrosion is the sample receiving cavity near the rotor periphery. Rotor failure caused by fatigue or overspeed may be more severe.

The most severe form of rotor failure is a so-called "bi-hub" failure, in which the rotor breaks into two relatively massive fragments. The origin of the failure in a bi-hub failure is usually in the vicinity of the rotor mounting recess. In such a failure, the containment system is designed to contain the fragments within the instrument such that the impact of the fragments may cause movement of the instrument in the laboratory.

Various forms of mechanical arrangements are known which minimize the possibility of rotor failure due to overspeed. One class of overspeed protection arrangement includes a frangible member which fractures when an overspeed condition is imminent to mechanically disconnect the rotor from its source of motive energy. U.S. Pat. No. 3,990,633 (Stahl), U.S. Pat. No. 4,568,325 (Cheng et al.), U.S. Pat. No. 4,753,630 (Romanauskas), and U.S. Pat. No. 4,753,631 (Romanauskas), the latter two patents being commonly assigned herewith are representative of this class of overspeed protection arrangement. Another overspeed protection arrangement generally of this form includes a frangible member which fractures when an overspeed condition is imminent to electrically disconnect the rotor from its source of motive energy. U.S. Pat. No. 3,101,322 (Stallman) is representative of this form of arrangement.

Another known overspeed protection arrangement also uses a frangible element on the rotor which fractures when rotor speed reaches a predetermined value. The fragment so produced causes the rotor to be braked by increasing windage within the chamber in which the rotor is carried or by mechanical friction with the surrounding structure, thereby slowing rotor speed. Representative of this class of overspeed protection arrangement are U.S. Pat. No. 4,693,702 (Carson et al.), U.S. Pat. No. 4,132,130 (Schneider), U.S. Pat. No. 4,509,896 (Linsker), and U.S. Pat. No. 4,507,047 (Coons).

Other arrangements are known which minimize the possibility of rotor failure due to fatigue of the material. One form of such a rotor protection arrangement limits the stress produced in the vicinity of the mounting of the rotor to the shaft. U.S. Pat. No. 4,822,330 (Penhasi) is believed exemplary of this class of device. DE-A-3806284 (Hirsch) discloses a centrifuge rotor having portions of the undersurface removed to reduce stress in the rotor.

Another alternative to control the effects of rotor failure is to design a rotating apparatus, as a flywheel, to exhibit predetermined areas of vulnerability of rupture. The area of vulnerability may be defined by regions of weaker material or stress risers in the material of the flywheel. Thus, in the event of an overspeed, failure will most likely occur in the area of vulnerability, producing a fragment having a predictable mass. U.S. Pat. No. 3,662,619 (Seeliger) and U.S. Pat. No. 4,111,067 (Hodson) are believed exemplary of this class of device.

Still another alternative to controlling rotor failure is set forth in U.S. Pat. No. 5,279,538 (Carson), wherein a centrifuge rotor is characterized by a portion of the undersurface thereof being removed to define a predetermined number of bosses, each with a sample receiving cavity therein.

U.S. Pat. No. 5,562,554 (Carson) discloses a centrifuge rotor having a central hub with a mounting recess therein, a ring disposed concentrically about the hub, the ring having a plurality of cavities formed therein, and a relatively thin web connecting the hub and the ring. The web defines a localized region which exhibits a stress therein that is greater than the stress present in any other portion of the rotor when the rotor is operating at the predetermined operating speed, so that, over operation time, the probability that rotor failure will occur only in the web is enhanced.

Occasionally, rotors from a centrifuge break apart due to the high speeds and centrifugal forces to which they are exposed. In a bi-hub failure of a fixed angle centrifuge rotor, such as that set forth in FIG. 1, the rotor body fragments will have a transitional and rotational velocity.

In centrifuge 100 shown in FIG. 1, after contacting the centrifuge chamber 140 and guard ring 130, the rotor body fragments will travel in a vertical direction and come into contact with lid 180 which could prove to be potentially harmful should lid 180 not be able to contain such a force imparted by a rapidly moving rotor body fragment. A typical centrifuge 100, as shown in FIG. 1, includes an outer casing 120 which completely surrounds a centrifuge chamber or bowl 140. Disposed between centrifuge chamber 140 and outer casing 120 is guard ring 130. Casing 120 is provided with an access opening 160 through which rotating elements are inserted for centrifugation of their contents within centrifuge 100. Access opening 160 is covered by a suitable door or lid 180 when centrifugation is in progress. Centrifuge chamber 140 is mounted within casing 120 by any suitable support arrangement such as that shown in FIG. 1 in which casing 120 has inwardly depending shoulders 200 which receive a lip or flange 220 disposed circumferentially about the top portion of centrifuge chamber 140. Of course, any suitable mounting arrangement may be utilized.

Container 140 is typically defined by a substantially cylindrical sidewall portion 240 having an annular floor or bottom 260 connected thereto. In practice, sidewall 240 and floor 260 are formed integrally one with the other by a stamping operation. Located centrally and axially of floor 260 of container 140 is an opening 280 defined by a curled back lip portion 300. Lip 300 extends upwardly into the volume defined on centrifuge chamber 140. The exterior surface of sidewall 240 may be provided with impact absorbing shielding or guard ring 130 and/or evaporator coils (not shown) if centrifuge 100 is a refrigerated centrifuge.

Extending upwardly along the central axis of container 100 and projecting into the region or volume defined on the interior of container 140 is a gyro shaft 320. Shaft 320 is supported by suitable bearings with a rotor gyro 340. Gyro 340 is supported from an abutment 360 mounted to casing 120. A rubberized boot 380 received by lip 300 closes the space between lip 300 and gyro 340.

Rotational force is imparted to shaft 320 (and to a rotating element mounted thereon) connected by a pulley and belt 400 with a source of motive energy shown as a motor 420. The direction of rotor rotation is shown by the arrow 'W' about the spin axis 500. The upper end portion of shaft 320 is provided with a spud 440 adapted to receive thereon the central hub of a rotating element, or rotor 460F, having a correspondingly configured central axial well therein. The rotor, when placed and secured to spud 440, is thereby mounted for rotational movement within centrifuge chamber 140.

When the rotor breaks apart into fragments, the fragments have a translational velocity substantially in a radial plane and a rotational velocity substantially parallel to the spin axis. When a fragment strikes the wall of the chamber or guard ring, the fragment will continue to rotate about the strike point in a direction substantially parallel to the spin axis. This rotation is caused by the moment at impact due to the center of gravity of the fragment not being on the same plane as the point of the rotor that first strikes the wall of the centrifuge chamber or guard ring.

The present inventors have discovered that if the center of gravity of a rotor body fragment is above a predetermined strike point plane, the fragment moves toward the centrifuge door or lid. This is due to the rotational velocity of the fragment and the moment created about the center of gravity of the fragment which cause it to move upwards toward the centrifuge door, typically in a spiral-type pattern. The present inventors have also discovered that one method of minimizing the challenge to the door would be to control the position of the rotor body fragment's center of gravity in relation to the strike point which is typically on the rotor's outer most edge or largest diameter. If the rotor body fragment's center of gravity is below the strike plane, then the fragment moves toward the floor of the centrifuge chamber. Downward movement of the fragment causes the centrifuge device to transmit a downward force against the floor or table top which absorbs such a shock rather than against the centrifuge door or lid which is less desirable.

A second method to minimizing the challenge to the door would be to configure the shape or strength of the centrifuge chamber or guard ring to counteract the effect of the moment at impact thereby preventing the fragment from moving toward the centrifuge lid.

The present invention also provides many additional advantages which shall become apparent as described below.

SUMMARY OF THE INVENTION

A method for controlling the motion of a rotor body fragment after a centrifuge rotor failure has occurred within a centrifuge assembly which comprises a rotor body, a centrifuge chamber and a centrifuge lid. This method comprises the step of maintaining the position of the center of gravity of the rotor body fragment such that it is at or below the strike point plane between the outermost edge of the rotor body and a sidewall of the centrifuge chamber or guard ring; wherein the rotational velocity and the moment of the rotor body fragment causes it to move along the centrifuge chamber away from the centrifuge lid. The rotor body is shaped such that the outermost edge thereof is disposed at or near the strike point plane.

The present invention also includes a centrifuge assembly which comprises a rotor body, a centrifuge chamber and a centrifuge lid, wherein a lower portion of the centrifuge chamber contains an outward perturbation which causes the moment of a rotor body fragment, which is the result of a centrifuge rotor failure, to move the rotor fragment along the centrifuge chamber away from the centrifuge lid. In particular, the perturbation preferably conforms substantially to the shape of the outer surface of the rotor body.

In the event that the perturbation does not perfectly conform to the outer surface of the rotor body, a situation may arise where the center of gravity of the rotor fragment may be above the strike point, thus creating a moment which causes the fragment to travel toward the centrifuge lid. However, as the fragment rotates about the strike point, the next subsequent impact of the fragment within the perturbation will create a moment in the reverse direction from the initial moment. This secondary moment will thus move the fragment away from the centrifuge lid.

According to another embodiment of the present invention the centrifuge assembly may comprise a rotor body, a centrifuge chamber, a guard ring disposed about the outside of the centrifuge chamber and a centrifuge lid, wherein the guard ring is sloped away from the a lower portion of the centrifuge chamber which causes the moment of a rotor body fragment, which is the result of a centrifuge rotor failure, to move the rotor fragment along the centrifuge chamber and the guard ring away from the centrifuge lid. In addition, in the event that the moment of the rotor body moves the rotor fragment toward the lid, as the fragment rotates about the strike point, the next subsequent impact will create a moment in the reverse direction from the initial moment. This secondary moment will thus move the fragment away from the centrifuge lid.

Still another embodiment of the present invention involves a centrifuge assembly which comprises a rotor body, a centrifuge chamber and a centrifuge lid, wherein an upper portion of the centrifuge chamber has a reinforcing member disposed thereabout such that it causes the moment of a rotor body fragment, which is the result of a centrifuge rotor failure to move the rotor fragment along the centrifuge chamber away from the centrifuge lid. The reinforcing member is in the shape of a metal plate or at least one metal ring disposed above the strike point plane.

A further embodiment of the present invention involves a centrifuge assembly which comprises a rotor body, a centrifuge chamber, a guard ring disposed about the outside portion of the centrifuge chamber and a centrifuge lid, wherein an upper portion of the guard ring has a reinforcing member disposed thereabout such that it causes the moment of a rotor body fragment, which is the result of a centrifuge rotor failure, to move the rotor fragment along the centrifuge chamber away from the centrifuge lid.

Finally, the present invention also includes a centrifuge rotor operable to rotate about an axis of rotation at a predetermined operating speed, the rotor having a rotor body with an undersurface wherein a skirt portion is disposed on the undersurface thereby forming an outermost edge of the rotor body and a ring member disposed at the end of the rotor body of the skirt portion having a substantially similar circumference to the outer circumference of the skirt portion, thereby minimizing any tendency to develop a moment of a rotor body fragment, caused due to rotor failure, to move the rotor fragment along the centrifuge chamber towards the centrifuge lid. The ring member is either formed integrally together with the rotor body or attached thereto.

Other and further objects, advantages and features of the present invention will be understood by reference to the following specification in conjunction with the annexed drawings, wherein like parts have been given like numbers.

DESCRIPTION OF THE PREFERRED EMBODIMENTS

Figure 1:
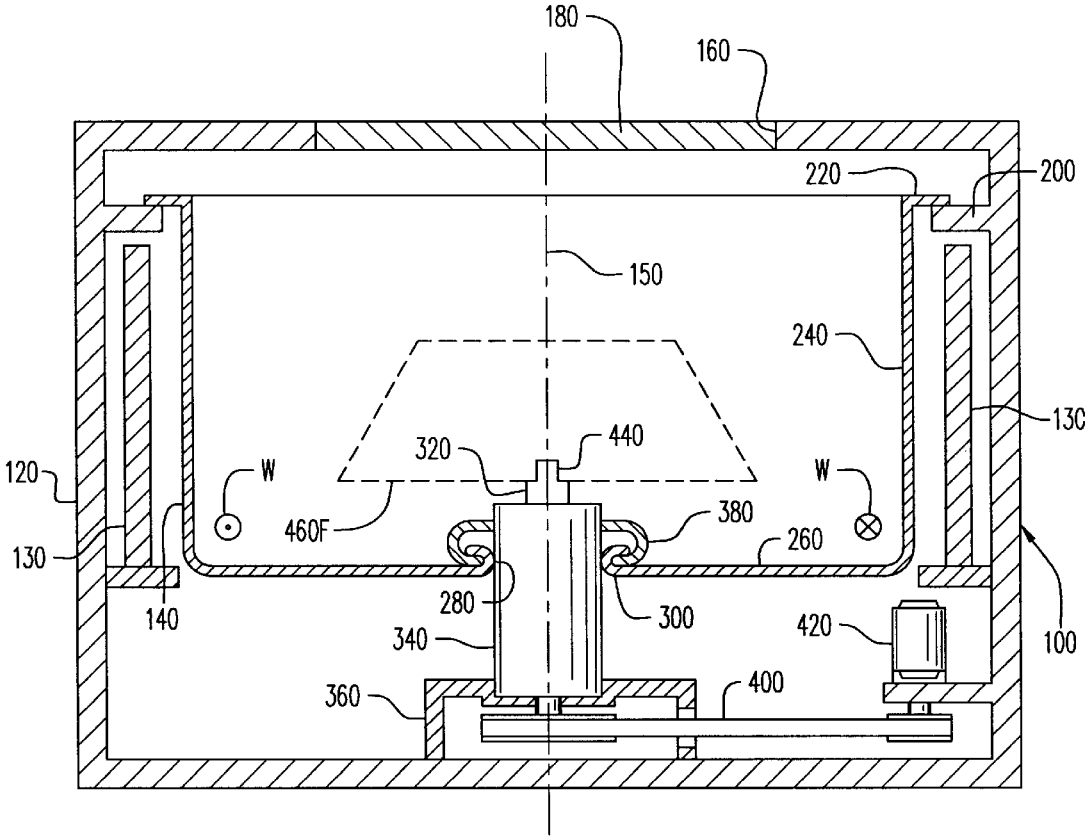
FIG. 1 (PRIOR ART)
FIG. 1 is a schematic partial cross-sectional view of a centrifuge with a fixed angle rotor according to the prior art.
Figure 2A:
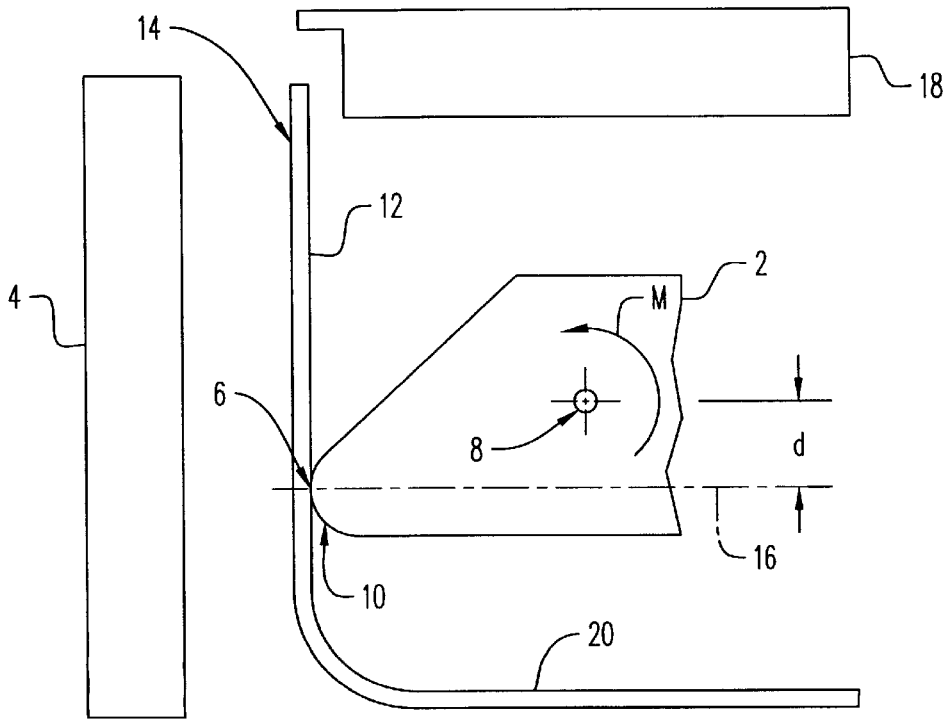
FIG. 2a (PRIOR ART)
FIG. 2*a* is a schematic partial cross-sectional view of a rotor body fragment adjacent to a sidewall of a centrifuge chamber where its center of gravity (CG) is above the strike point plane, thereby causing the rotor body fragment to flip upwards towards the door according to the prior art.

The present invention relates to a method and apparatus for controlling the motion of a rotor body fragment 2 after a rotor failure has occurred. In a bi-hub failure of a fixed angle centrifuge rotor body fragments 2 will have a transitional and a rotational velocity. When the two rotor body fragments 2 of the rotor body strike the sidewall of the evaporator or the guard ring 4, the rotor body fragments 2 will rotate about the strike point 6 as shown in FIG. 2*a*. The rotation, depicted by the arrow 'M', of rotor body fragment 2 is caused by the center of gravity 8 of fragment 2 not being on the same plane as the outermost end 10 of rotor body fragment 2 that first hits sidewall 12 of centrifuge chamber 14. FIG. 2*a* depicts an undesirable situation wherein center of gravity 8 of rotor body fragment 2 is a distance 'd' above strike point plane 16. If, as shown in FIG. 2*a*, the center of gravity 8 of rotor body fragment 2 is above the strike point plane, the moment of rotor body fragment 2 causes it to move in a counter clockwise direction such that it moves towards centrifuge lid or door 18. That is, the rotational velocity of rotor body fragment 2 causes it to spiral upwards toward centrifuge lid 18.

Figure 2B:
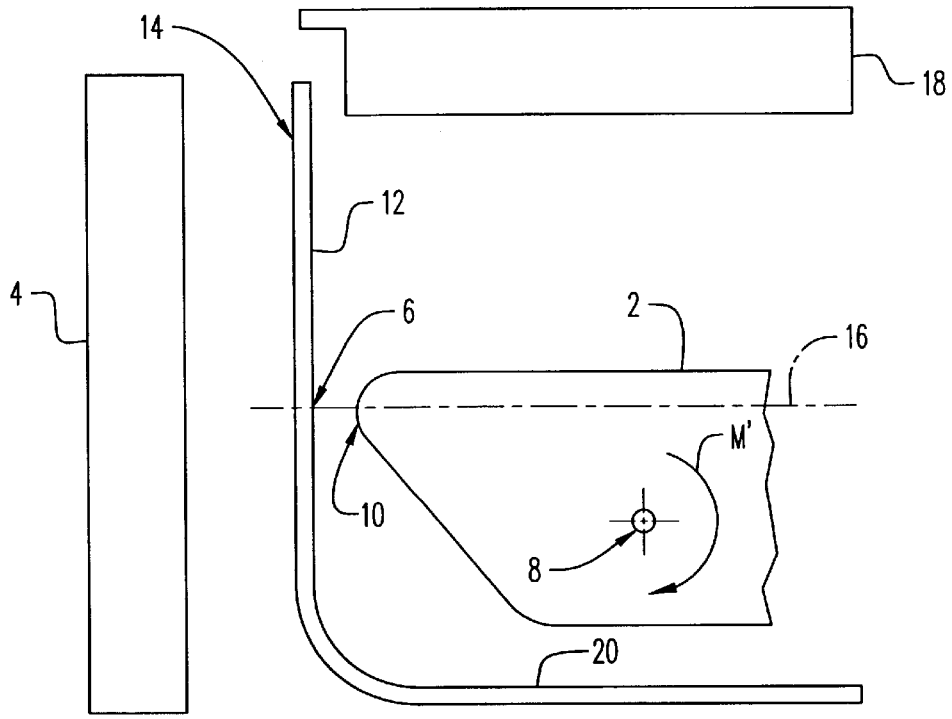
FIG. 2*b* is a schematic partial cross-sectional view of a rotor body fragment adjacent to a sidewall of a centrifuge chamber where its center of gravity (CG) is below the strike point plane, thereby causing the rotor body fragment to flip downwards away from the door in accordance with the present invention.

The present inventors have discovered that one means of minimizing the challenge to centrifuge lid 18 is to control the position of rotor body fragment 2, as shown in FIG. 2*b*, such that its center of gravity 8 is at or below strike point plane 16. If center of gravity 8 is at or below strike point plane 16, then the moment M' of rotor body fragment 2 will cause it to at least remain neutral or be moved down towards floor 20 of centrifuge chamber 14.

Figure 3A:
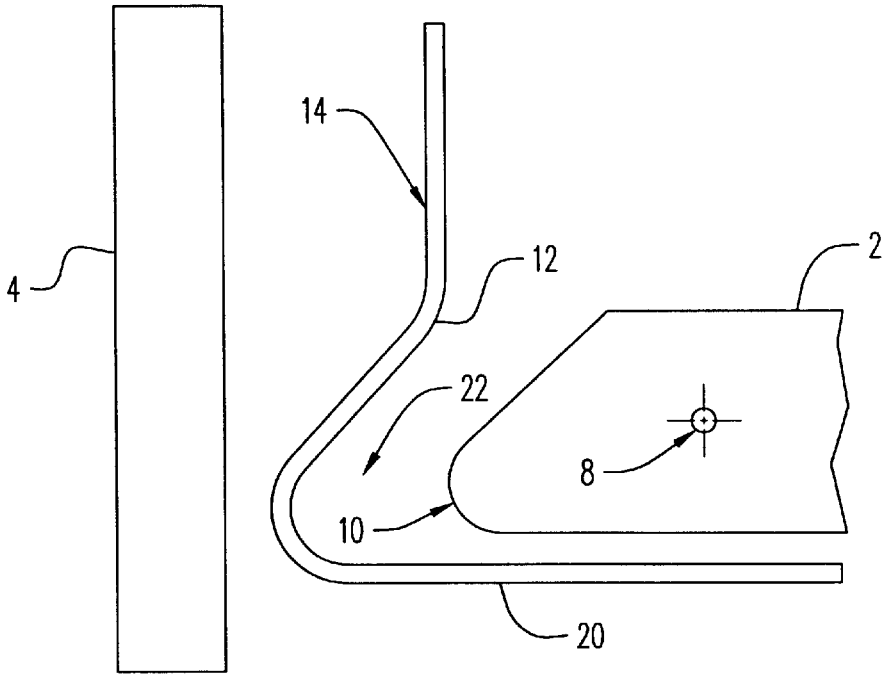
FIG. 3*a* is a schematic partial cross-sectional view of a rotor body fragment adjacent to a sidewall of a centrifuge chamber, wherein the sidewall has been shaped to the rotor profile such that any upward movement of the rotor body fragment is minimized in accordance with another embodiment of the present invention.

A second method of controlling the rotor movement after a rotor failure or burst is to shape centrifuge chamber 14 to minimize the movement of rotor body fragment 2 during a bi-hub failure. FIG. 3*a* shows that if centrifuge chamber 14 can be shaped to the rotor profile (i.e., having a concave-shaped perturbation 22) near floor 20, any upward movement of rotor body fragment 2 will be minimized.

Figure 3B:
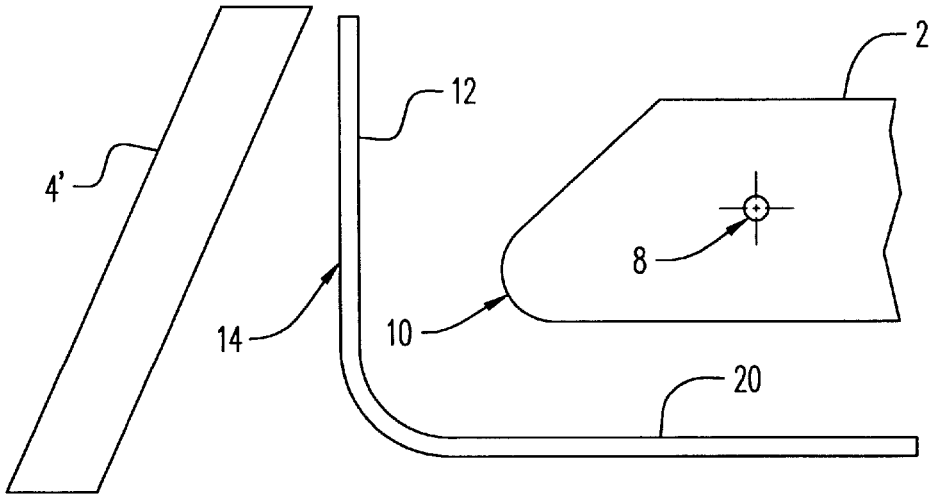
FIG. 3*b* is a schematic partial cross-sectional view of the rotor body fragment adjacent to a sidewall of a centrifuge chamber, wherein the guard ring is formed in the shape of a truncated cone in accordance with still another embodiment of the present invention.

A variation of this approach would be to form guard ring 4' in the shape of a truncated cone such that its lower portion slopes away from sidewall 12 of centrifuge chamber 14. This would force rotor body fragments 2 toward floor 20 of centrifuge chamber 14 when guard ring 4' is struck, as shown in FIG. 3*b*.

Figure 4A:
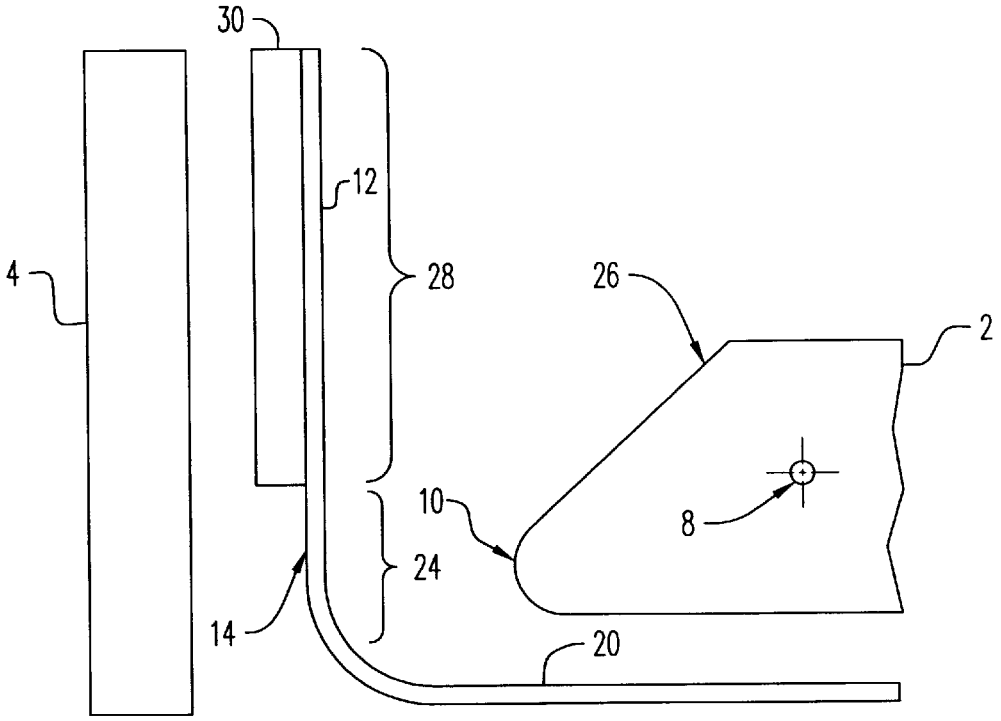
FIG. 4*a* is a schematic partial cross-sectional view of the rotor body fragment adjacent to a sidewall of a centrifuge chamber, wherein the centrifuge chamber sidewall has been reinforced in accordance with yet another embodiment of the present invention.
Figure 4B:
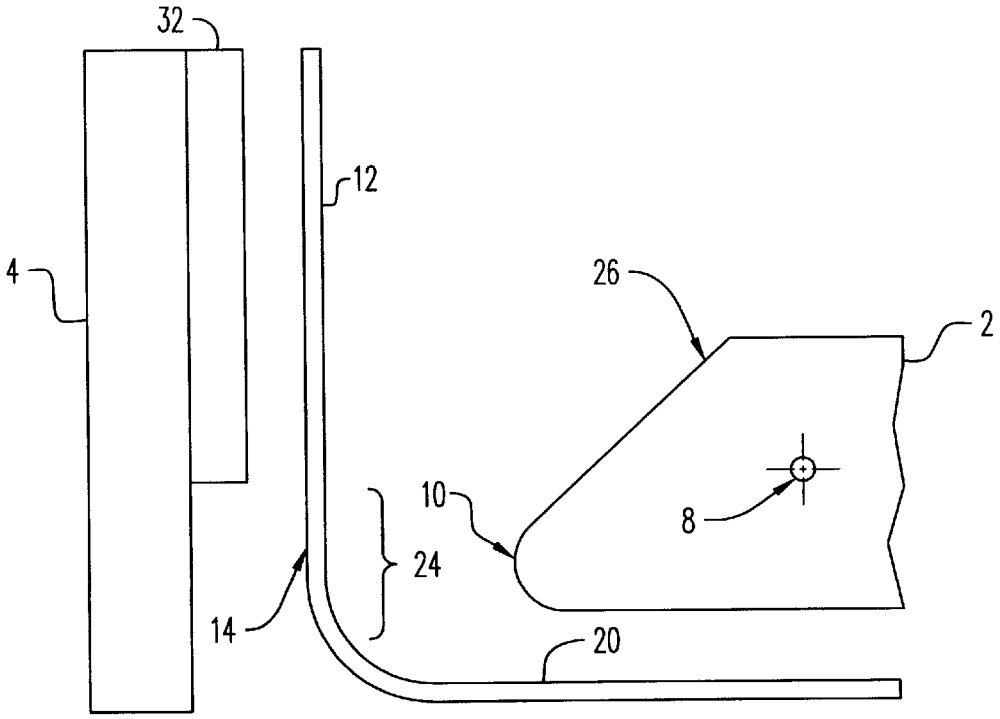
FIG. 4*b* is a schematic partial cross-sectional view of the rotor body fragment adjacent to a sidewall of a centrifuge chamber, wherein the guard ring has been reinforced in accordance with another embodiment of the present invention.
Figure 4C:
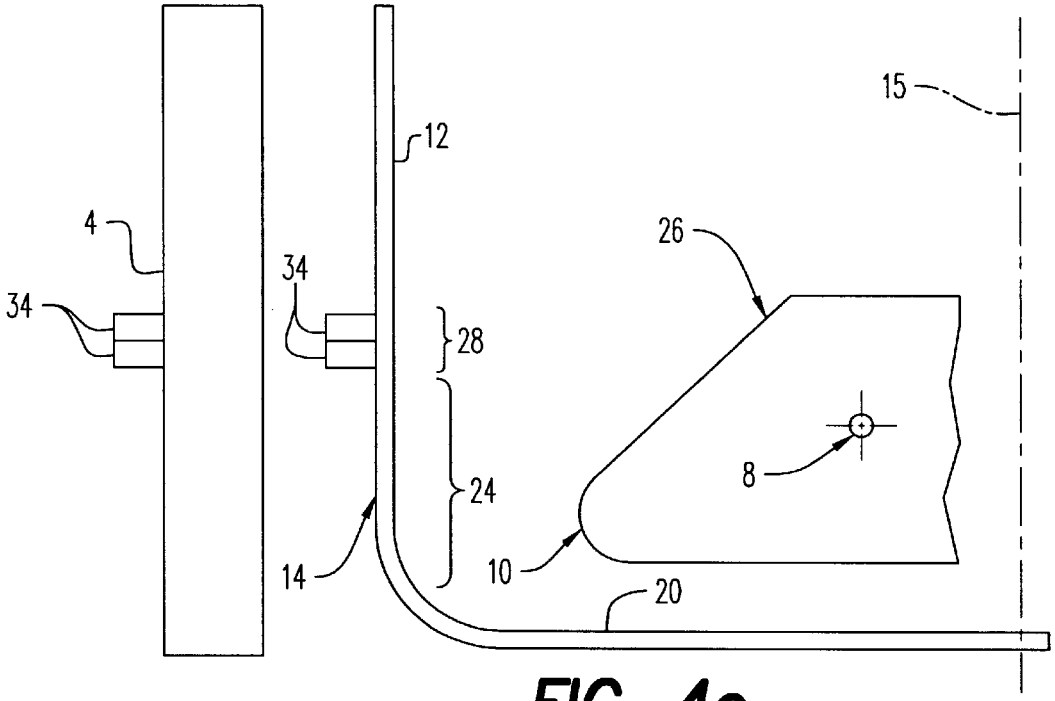
FIG. 4*c* is a schematic partial cross-sectional view of the rotor body fragment adjacent to a sidewall of a centrifuge chamber, wherein a pair of rings has been disposed about either the centrifuge chamber sidewall or guard ring at or above the center of gravity location of the rotor body fragment in accordance with another embodiment of the present invention.

A third method of controlling movement of rotor body fragment 2 after a burst is to vary the strength of centrifuge chamber 14 or guard ring 4, as shown in FIGS. 4*a–c*. According to FIG. 4*a*, if centrifuge chamber 14 has a lower strength at the point of impact (i.e., strike point), rotor body fragment 2 will easily deform this lower strength area 24. At some point in the impact, the upper portion 26 of rotor body fragment 2 will contact the reinforced area 28 of centrifuge chamber 14. Centrifuge chamber 14 is reinforced in FIG. 4*a* via a reinforcing metal member 30, which is preferably in the shape of either a plate or at least one ring. Metal member 30 is disposed at or above the center of gravity 8 of rotor body fragment 2. Upon impact of the rotor body fragment 2 with reinforced area 28, a moment will be created in the reverse direction from the initial moment. This secondary moment will thus move fragment 2 away from the centrifuge lid 18.

This same method could be applied to guard ring 4 instead of centrifuge chamber 14, as shown in FIG. 4*b*. Guard ring 4 is reinforced with a reinforcing metal member 32 which is disposed above the strike point about centrifuge chamber 14 and/or at or near the center of gravity 8 of rotor body fragment 2. Metal member 32 is preferabaly in the shape of either a plate or at least one ring.

Figure 4D:
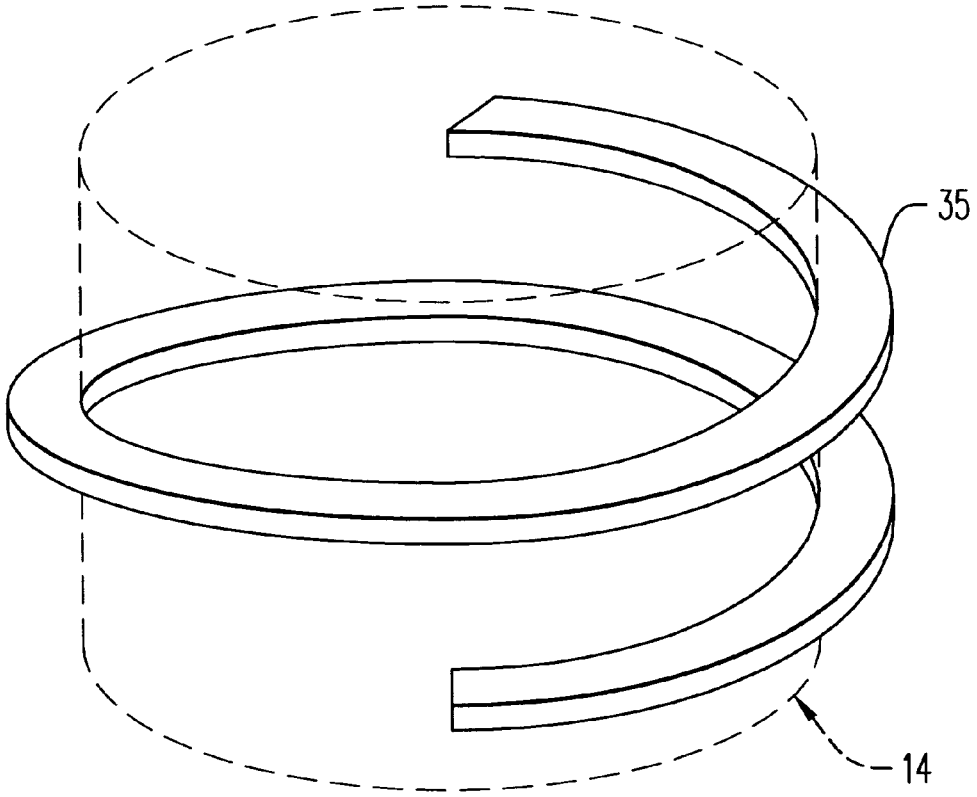
FIG. 4*d* is a schematic perspective view of a coarse multiple start helical thread which may be used in place of the rings shown in FIG. 4*c*.

Still another way to change the centrifuge chamber or guard ring stiffness would be to add a ring or rings 34 around chamber 14 or guard ring 4 at or near center of gravity 8 of rotor body fragment 2, as shown in FIG. 4*c*. These added rings 34 may be perpendicular to the centerline 15 of centrifuge chamber 14 or may be slanted to act so that a moment will be created in the reverse direction from the initial moment, thus forcing the rotor body fragment 2 toward floor 20 of centrifuge chamber 14. The added stiffening rings 34 may alternatively be shaped as a coarse multiple start helical thread 35, as shown in FIG. 4*d*, which would act as a screw thread to force rotor body fragments 2 downward. The hand of the thread would depend on the rotational direction of rotor body fragment 2. If the centrifuge is refrigerated, then the coils around the evaporator (not shown) which form the centrifuge chamber may be formed for this purpose.

Figure 5:
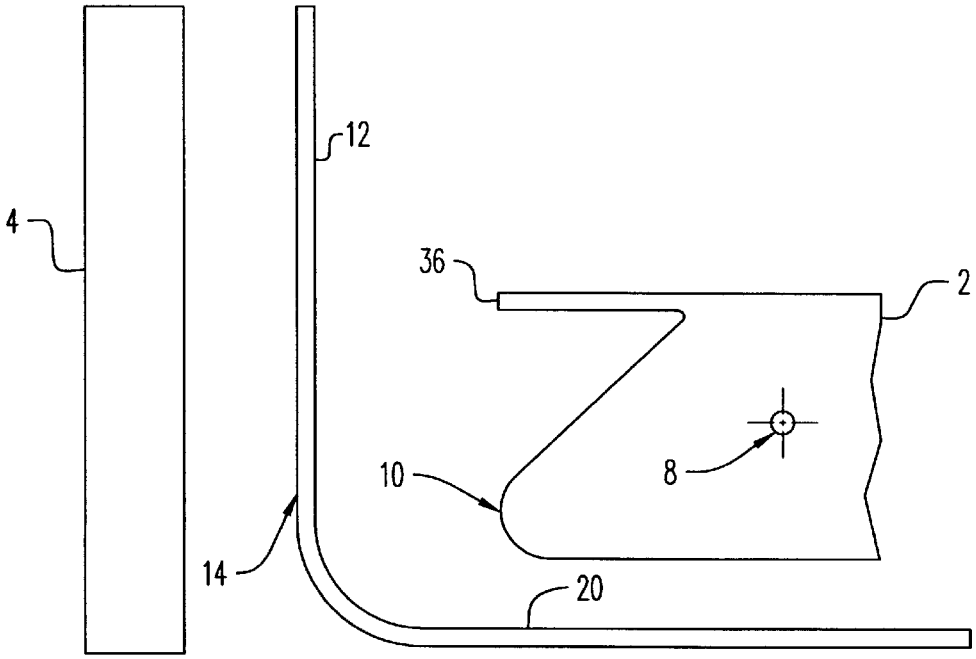
FIG. 5 is a schematic partial cross-sectional view of the rotor body fragment adjacent to a sidewall of a centrifuge chamber, wherein a ring is added at the top of the rotor body, thereby minimizing any tendency for the rotor body fragment to be moved toward the centrifuge door or lid in accordance with another embodiment of the present invention.

A fourth method of controlling the movement of rotor body fragment 2 is to add a ring 36 at the top of rotor body fragment 2, as shown in FIG. 5. The outer edge of ring 36 can be formed from the rotor body itself or added to it. Ring 36 would act to strike centrifuge chamber sidewall 12 at approximately the same time as the outermost edge 10 of rotor body fragment 2. This action minimizes any tendency for rotor body fragment 2 to be moved up towards the centrifuge door or lid.

While we have shown and described several embodiments in accordance with our invention, it is to be clearly understood that the same are susceptible to numerous changes apparent to one skilled in the art. Therefore, we do not wish to be limited to the details shown and described but intend to show all changes and modifications which come within the scope of the appended claims.

What is claimed is:

1. A method for controlling the motion of a rotor body fragment after a centrifuge rotor failure has occurred within a centrifuge assembly which comprises a centrifuge chamber, a centrifuge lid enclosing said centrifuge chamber, and a rotor body mounted for rotation within said centrifuge chamber, said method comprising the step of:

maintaining a position of a center of gravity of said rotor body fragment such that said center of gravity is at or below a strike point plane, wherein said strike point plane is a radial plane passing through an outermost point of said rotor body, and wherein a moment of said rotor body fragment causes said rotor body fragment to move along said centrifuge chamber away from said centrifuge lid.

2. A centrifuge assembly comprising a non-rotating centrifuge chamber, a centrifuge lid for providing access to and enclosing said centrifuge chamber, and a rotor body mounted for rotation within said centrifuge chamber, wherein a lower portion of said centrifuge chamber contains an outward perturbation radially adjacent to an outermost point of said rotor body to cause a moment of a rotor body fragment, which is a result of a centrifuge rotor failure, to move along said centrifuge chamber away from said centrifuge lid.

3. The centrifuge assembly according to claim 2, wherein said perturbation conforms substantially to a shape of said rotor body at said outermost point.

4. A centrifuge assembly which comprises a centrifuge chamber, a guard ring disposed about the outside of said centrifuge chamber, a centrifuge lid enclosing said centrifuge chamber, and a rotor body mounted for rotation within said centrifuge chamber, wherein said guard ring is sloped away from a lower portion of said centrifuge chamber to cause the moment of a rotor body fragment, which is the result of a centrifuge rotor failure, to move along said centrifuge chamber and said guard ring away from said centrifuge lid.

5. A centrifuge assembly comprising:

a centrifuge chamber;

a centrifuge lid enclosing said centrifuge chamber;

a rotor body mounted for rotation within said centrifuge chamber; and a reinforcing member for causing a rotor body fragment to move in a direction away from said centrifuge lid, said reinforcing member being disposed about and in contact with said centrifuge chamber at or above a center of gravity of said rotor body fragment.

6. The centrifuge assembly according to claim 5, wherein said reinforcing member is in the shape of a plate.

7. The centrifuge assembly according to claim 5, wherein said reinforcing member is in the shape of at least one ring.

8. A centrifuge assembly comprising:

a centrifuge chamber;

a centrifuge lid enclosing said centrifuge chamber;

a rotor body mounted for rotation within said centrifuge chamber;

a guard ring disposed about an outside portion of said centrifuge chamber; and a reinforcing member for causing a rotor body fragment to move in a direction away from said centrifuge lid, said reinforcing member being disposed about and in contact with a substantial portion of an axial surface of said guard ring at or above a center of gravity of said rotor body fragment.

9. The centrifuge assembly according to claim 8, wherein said reinforcing member is in the shape of either a plate or at least one ring.

10. A centrifuge assembly comprising:

centrifuge chamber;

a centrifuge lid enclosing said centrifuge chamber;

a rotor body mounted for rotation within said centrifuge chamber; and a reinforcing member for causing a rotor body fragment to move in a direction away from said centrifuge lid, said reinforcing member being disposed about and in contact with said centrifuge chamber axially above an outermost point of said rotor body.

11. A centrifuge assembly comprising:

a centrifuge chamber;

a centrifuge lid enclosing said centrifuge chamber;

a rotor body mounted for rotation within said centrifuge chamber;

a guard ring disposed about an outside portion of said centrifuge chamber; and a reinforcing member for causing a rotor body fragment to move in a direction away from said centrifuge lid, said reinforcing member being disposed about and in contact with a substantial portion of an axial surface of said guard ring axially above an outermost point of said rotor body.

* * * * *